US007029535B1

(12) United States Patent
Bechtold, Jr.

(10) Patent No.: US 7,029,535 B1
(45) Date of Patent: Apr. 18, 2006

(54) PAINT SHIELDS FOR LIGHT FIXTURES

(76) Inventor: Joseph A. Bechtold, Jr., 1173 Winston Rd., South Euclid, OH (US) 44121

( * ) Notice: Subject to any disclaimer, the term of this patent is extended or adjusted under 35 U.S.C. 154(b) by 0 days.

(21) Appl. No.: 10/807,953

(22) Filed: Mar. 24, 2004

Related U.S. Application Data

(60) Provisional application No. 60/458,597, filed on Mar. 28, 2003.

(51) Int. Cl.
*B05C 21/00* (2006.01)

(52) U.S. Cl. ..... 118/504; 118/505

(58) Field of Classification Search ..... 118/504, 118/505; 52/220.6, 506.07; 427/272, 282
See application file for complete search history.

(56) References Cited

U.S. PATENT DOCUMENTS

| | | | | |
|---|---|---|---|---|
| 236,707 | A | 1/1881 | Jones | |
| 456,775 | A | 7/1891 | Prescott | |
| 1,799,913 | A | 4/1931 | Lemmons | |
| 1,817,928 | A | 8/1931 | Panitzsch | |
| 2,098,005 | A | 11/1937 | Holt | 91/65 |
| 2,484,607 | A | 10/1949 | Cherem | 91/65 |
| 2,517,220 | A | 8/1950 | Lister | 91/65 |
| 3,091,218 | A | 5/1963 | Wilson et al. | 118/505 |
| 3,565,038 | A | 2/1971 | Van Barriger | 118/504 |
| 4,196,692 | A | 4/1980 | Vanstrom | 118/504 |
| 4,235,192 | A | 11/1980 | Brubaker | 118/504 |
| 4,411,219 | A | 10/1983 | Keith et al. | 118/505 |
| 5,012,852 | A | 5/1991 | Blackhurst | 160/351 |
| 5,056,458 | A | 10/1991 | Askeland | 118/505 |
| 5,109,793 | A | 5/1992 | Ballejos | 118/505 |
| 5,306,347 | A | 4/1994 | Semle et al. | 118/504 |
| 5,354,377 | A | 10/1994 | Jeffrey, Jr. | 118/505 |
| 5,420,775 | A | 5/1995 | Kusmer | 362/376 |
| 5,494,519 | A | 2/1996 | Jeffrey, Jr. | 118/504 |
| 6,397,531 | B1 * | 6/2002 | Martin | 52/220.6 |

* cited by examiner

*Primary Examiner*—Laura Edwards
(74) *Attorney, Agent, or Firm*—David A. Burge

(57) ABSTRACT

Paint shields formed from relatively stiff but pliable material are configured to cover the transparent or translucent lenses of light fixtures so that frames of the fixtures which extend perimetrically about the lenses can be painted by brush, by roller or by spray without getting paint on the lenses. Edge regions of the paint shields are configured to be inserted between the frames and the lenses, and central regions of the paint shields preferably are transparent or translucent to permit light from the fixtures to pass through the installed paint shields. Peripheral regions of the shields preferably are provided with visible guide formations or may be scored or perforated to facilitate trimming the shields to fit small and undersized fixtures. Central portions may be designed to fold away from other portions of the shields to stiffen the installed shields to minimize sagging.

47 Claims, 12 Drawing Sheets

PAINT SHIELDS FOR LIGHT FIXTURES

REFERENCE TO PROVISIONAL APPLICATION

This application claims the benefit of U.S. Provisional Application Ser. No. 60/458,597 entitled PAINT SHIELDS FOR LIGHT FIXTURES filed Mar. 28, 2003 by Joseph A. Bechtold, Jr., the disclosure of which is incorporated herein by reference.

BACKGROUND OF THE INVENTION

1. Field of the Invention

The present invention relates to paint shields formed from relatively stiff but pliable material configured to protectively cover the transparent or translucent lenses of light fixtures so that frame components of the fixtures which extend perimetrically about the lenses can be painted by brush, by roller or by spray without getting paint on the lenses. More particularly, the present invention relates to plural element paint shields having edge regions that can be temporarily inserted between edge regions of the lenses and their perimetrically extending frame components so the paint shields are supported by the same frame components that support the lenses of the fixtures while the frame components are being painted, whereafter the paint shields can be removed and preferably re-used. Elements of the paint shields optionally may be provided with at least central regions that permit light from the fixtures to pass therethrough, may have portions that can be folded to stiffen the paint shields against sagging, and may have visible guide formations extending along edge regions thereof to facilitate trimming the shield elements to fit fixtures of a variety of sizes.

2. Prior Art

Paint shields of various types have been pro-posed to mask selected surface areas of window panes, walls, doors and woodwork to prevent paint that is being applied to nearby surfaces from being splattered onto the areas that are masked by the shields.

While many types of paint shields have been proposed, few have been found to be of use in masking large surface areas of the light fixture lenses that typically are found in grid supported ceilings of modern office buildings. When ceilings and/or ceiling grids and exposed light fixture frame surfaces are to be painted, what often is done is to tape sheets of newspaper or other disposable sheet stock to the lenses of light fixtures—a task that is labor intensive and hard on the backs and necks of the workers who have been hired to perform it—a task that typically requires many yards of tape and a great deal of patience to install the tape with a suitable degree of precision.

Where large rooms of commercial buildings have dozens of fluorescent fixtures in suspended tile ceilings that need their lenses masked to permit the perimetrically extending lens support components of the fixtures to be spray painted, it may require several people working for many hours, if not days, to complete the masking of the lenses; and, when the lenses are masked, relatively little fixture generated light may be permitted to escape into the room to illuminate the room during the painting process—a drawback that often needs to be addressed by providing auxiliary lighting to ensure that paint is properly applied. When the paint has dried, an equally large amount of labor may be required to remove the masking materials and to remove tape residue.

A need exists for simple and inexpensive, easy to install and easy to remove, light fixture paint shields for temporarily protectively covering the lenses of light fixtures when paint is being applied nearby—shields that preferably require no tape to hold them in place, that can be removed without leaving residue on the fixtures, and that preferably can be reused a reasonable number of times.

SUMMARY OF THE INVENTION

What the present invention provides are plural element paint shields 1) that can be installed quickly and easily to mask the lenses of light fixtures such as ceiling light fixtures in grid supported ceilings; 2) that also can be removed quickly and easily without causing damage to the paint shields and without leaving behind any tape or other residue; 3) that preferably are formed from inexpensive but durable stock that will permit their being reused a reasonable number of times; and 4) that, in their preferred form, permit fixture generated light to pass therethrough to illuminate the interiors of rooms where painting is underway so that auxiliary lighting systems need not be installed. Optionally the shields may be provided with visible guide formations along peripheral regions thereof to aid one in trimming the shields to accommodate fixtures of a variety of sizes, and may be provided with fold away or fold down portions to rigidify installed shields.

In one form of the invention, a plural element paint shield is provided for temporarily protectively covering a lens of a light fixture, wherein the shield includes a plurality of paint shield elements each of which is configured to protectively cover a separate portion of the front face of the lens when in an installed position. In their installed position, the paint shield elements extend in adjacent side by side relationship to substantially contiguously cover the front face of the lens, and adjacent ones of the paint shield elements have portions that are configured to overlap. Each of the paint shield elements has edge portions that are configured to extend between the frame and the perimeter portions of the front face of the lens when in the installed position; and, each is formed from relatively thin, relatively stiff material that is pliable enough to permit central portions thereof to flex away from the front face of the lens as may be needed to permit the edge portions to be inserted between the frame and the perimeter portions of the front face of the lens.

When working with generally rectangular ceiling mounted light fixtures of the type wherein the lens has a width dimension and a length dimension, and wherein the fixture has a frame lip that extends about and underlies peripheral edge portions of the lens, the invention preferably takes the form of plurality of paint shield elements that are configured to be positioned side by side in an array that forms a rectangular cover having length and width dimensions that substantially equal the length and width dimensions of the lens. The array of elements has peripheral edge portions configured to be inserted between the frame lip and the peripheral edge portions of the lens to support the elements in positions that closely underlie the lens when the array of paint shield elements is installed to protectively cover the lens. In most preferred practice, rectangular ceiling mounted fixtures are protectively covered by utilizing a pair of substantially identical paint shield elements, one of which covers one end region of the lens of the fixture, and the other of which covers an opposite end region of the lens of the fixture, with the paint shield elements having portions that overlap to cover a central region of the lens of the fixture.

When working with fixtures that have at least two opposed parallel extending sides, it is preferred that all of the paint shield elements have a common dimension that substantially equals a selected one of the length and width dimensions of the light fixture lens that the paint shield elements are to protect—so that each of the paint shield elements, when installed, bridges the full width or the full length of the protectively covered lens so that opposite portions of each of the paint shield elements is supported by being inserted between a frame lip and an edge portion of the lens. And, in most preferred practice, at least one of the installed paint shield elements has a turn-away or fold-down portion that can be bent away from the plane of the protected lens so as to strengthen and rigidify at least the one paint shield element against sagging under the influence of the force of gravity.

While the paint shield elements may be constructed of a wide range of known and yet unknown materials, the present-day materials that are preferred include cardboard, fiberboard, chipboard or sheets of plastic material—materials that are thin, preferably exhibit a degree of rigidity that resists sagging, and are relatively inexpensive so that, after one use or after a reasonable number of repeated uses, the shield elements may be discarded. If cardboard, fiberboard, chipboard or other porous materials are used in fabricating the paint shield elements, these materials preferably are provided with a coating or finish that helps to prevent water from latex paint being absorbed into the material, for example a wax or shellac coating. If the paint shield elements are to permit fixture generated light to pass therethrough, the paint shield elements may be formed from transparent or translucent material such as plastic sheets (that may have been vacuum formed to incorporate stiffening formations), or may be have central regions formed from parchment paper or thin films or sheets of plastic to provide transparent or translucent regions through which light can pass.

In a most preferred form of the invention, each of the paint shield elements has a central region formed primarily from material that permits light from a light fixture on which the paint shield is installed to pass therethrough, and a surrounding peripheral region that is formed from opaque material. By forming at least central regions of at least selected ones of the paint shield elements from materials that are transparent or translucent, the shield permit fixture generated light to pass therethrough to illuminate the room wherein the fixtures are installed. Safety and efficiency are enhanced by utilizing fixture generated light to illuminate the room being painted, and by permitting light to pass through the transparent or translucent regions.

To stiffen paint shield elements and minimize sagging under the influence of the force of gravity, the paint shield elements may be provided with fold away or fold down portions that can be deflected out of a main plane occupied by major portions of the installed paint shield elements. To facilitate the folding of stiffener portions of the paint shield elements, marked fold lines or lines of weakness may be provided that show where folds are to be made in the material of the paint shield elements. Likewise, to facilitate trimming the paint shield elements to proper sizes to overlie the lenses of light fixtures of a variety of sizes, marked cutting lines or lines of weakness may be provided that extend along selected portions of the perimeters of the paint shield elements. If lines of weakness are to be provided to facilitate folding or trimming, the lines of weakness may take the form of linearly extending press-formed score lines, or an linear-extending array of press-formed perforations that cut through portions of the material of the paint shields where folds or cuts are to be made.

BRIEF DESCRIPTION OF THE DRAWINGS

These and other features, and a fuller understanding of the present invention may be had by referring to the following description and claims, taken in conjunction with the accompanying drawings, wherein:

DESCRIPTION OF THE PREFERRED EMBODIMENT

Figure 1:
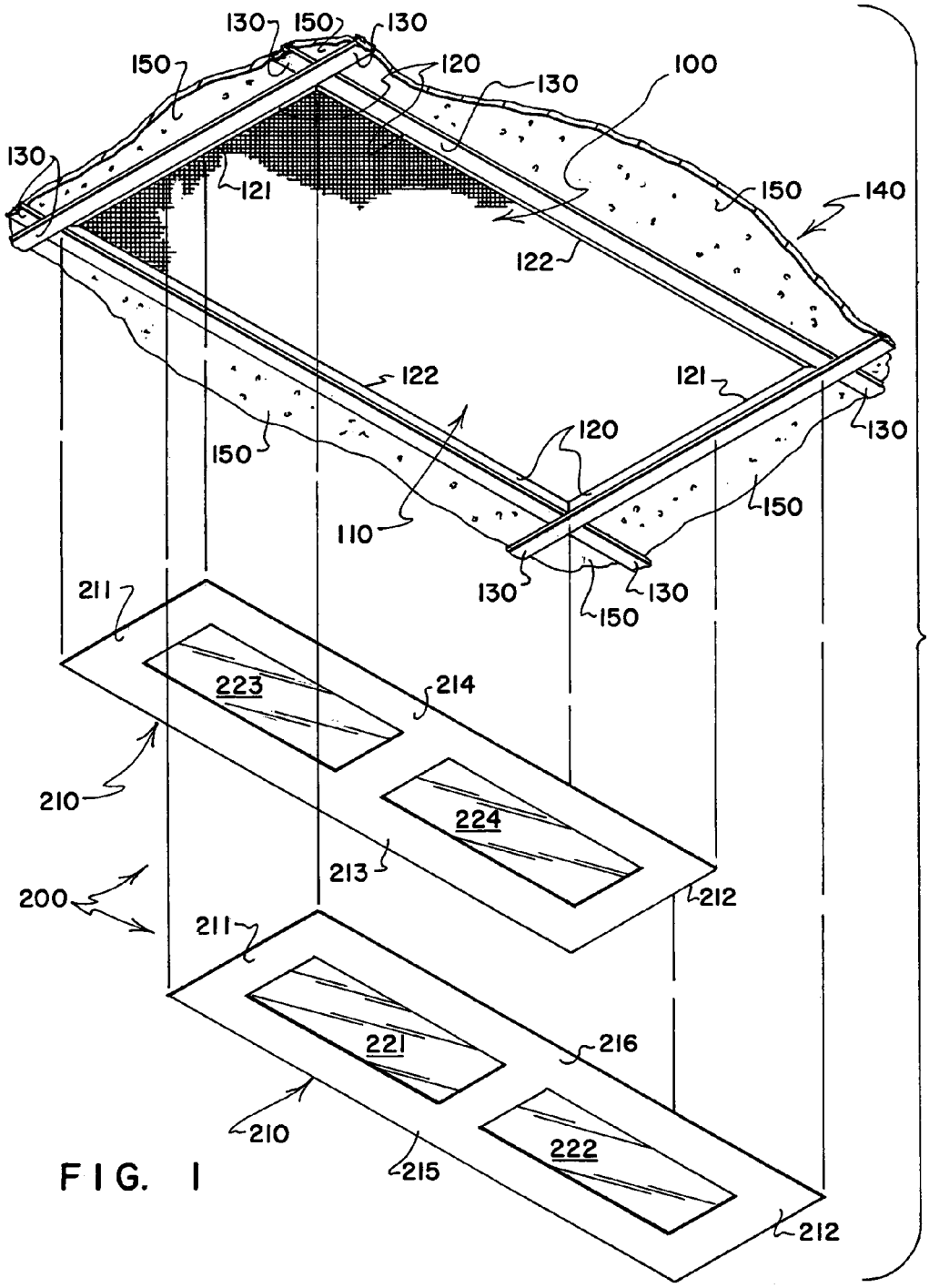
FIG. 1 is an exploded perspective view showing the rectangular lens of a light fixture together with fixture frame portions that extend perimetrically about the lens to underlie and support opposed sides and opposed ends of the lens, showing portions of the metal grid of a suspended tile ceiling that surround the light fixture, and showing a pair of identically configured paint shield elements that may be installed to mask the light fixture lens during painting of exposed surfaces of the fixture and ceiling, it being noted that the paint shield elements each have central regions that are transparent or translucent to permit the passage of fixture generated light therethrough.

Referring to FIG. 1, a generally rectangular transparent or translucent lens 100 of a commercially available light fixture 110 is perimetrically surrounded by a frame 120 that is supported by metal grid elements 130 of a conventional suspended ceiling 140. The ceiling grid elements 130 also extend about the periphery of a plurality of generally rectangular ceiling tile 150 so as to perimetrically support the tile 150 of the ceiling 140.

Figure 7:
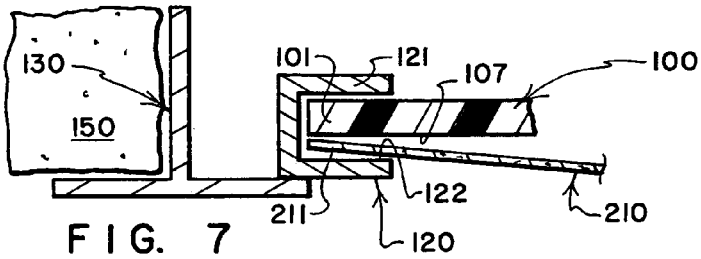
FIG. 7 is an enlarged cross-sectional view as seen from a plane indicated by a line 7—7 in FIG. 3.
Figure 8:
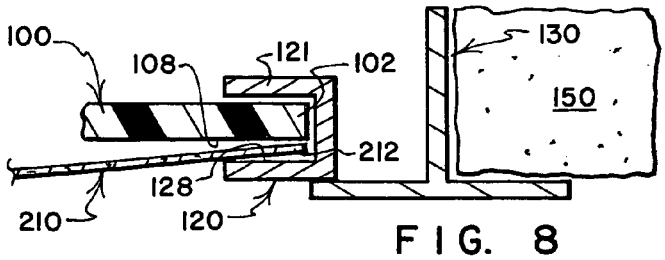
FIG. 8 is an enlarged cross-sectional view as seen from a plane indicated by a line 8—8 in FIG. 3.

The frame 120 has opposed end components 121 and opposed side components 122 that cooperate to provide a C-shaped channel that extends perimetrically about the lens 100 so as to receive peripheral portions of the lens 100 therein. Referring to FIGS. 7 and 8 wherein the identical channel-shaped or C-shaped cross sections of the opposed end components 121 of the frame 120 are depicted, it will be seen that opposite end regions 101, 102 of the lens 100 are received relatively loosely therein, with enough space being available to permit the end regions 101, 102 of the lens 100 to be raised slightly so that opposite end regions 211, 212 of a paint shield element 210 can be inserted therein between downwardly facing surfaces 107, 108 of the end regions 101, 102 of the lens 100, and upwardly facing surfaces 127, 128 of a bottom flange or lip of the end components 121 of the frame 120. Also seen in FIGS. 7 and 8 are the inverted T-shaped cross sections of the metal grid elements 130 of the ceiling.

Figure 6:
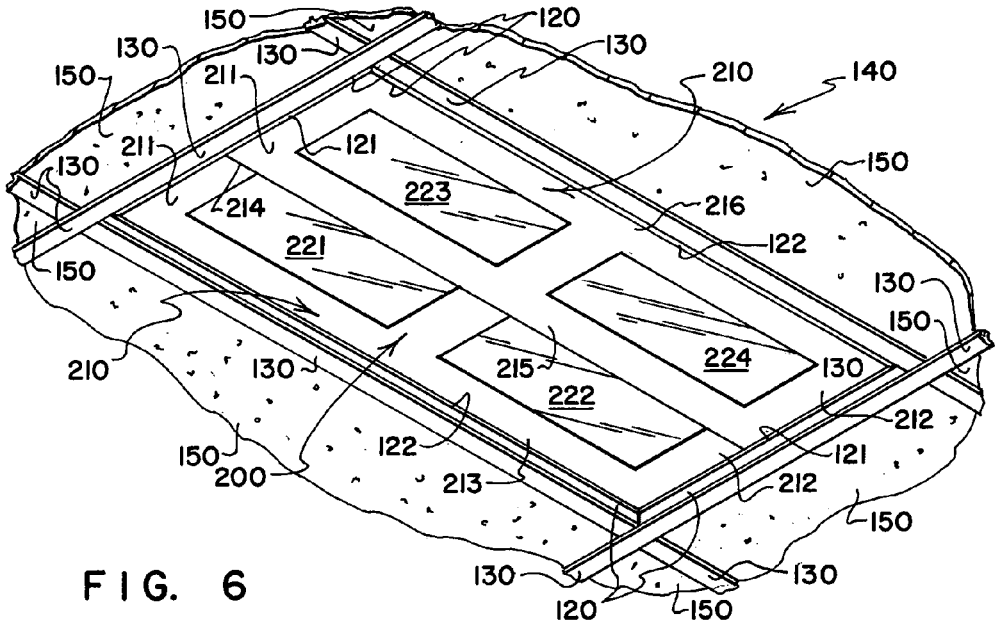
FIG. 6 is a perspective view of the ceiling mounted light fixture and the paint shield elements of FIG. 5, with both of the paint shield elements being in their fully installed positions wherein side portions of the paint shield elements are inserted between the downwardly facing surfaces of opposite side portions of the lens and the upwardly facing surfaces of fixture frame components that normally engage and support the side portions of the lens, and wherein end regions of the paint shield elements are inserted between the downwardly facing surfaces of opposite end regions of the lens and the upwardly facing surfaces of fixture frame components that normally engage and support the end regions of the lens.

Referring again to FIG. 1, a paint shield 200 is comprised of two identically configured shield elements 210. The shield elements 210 have opposed end regions 211, 212 and opposed side regions 213, 214, 215, 216. The shield elements 210 also have central regions 221, 222, 223, 224 that are transparent or translucent to let fixture generated light to pass therethrough when the shield elements 210 are installed on the fixture 110 to mask the lens 100, as is depicted in FIG. 6.

Figure 5:
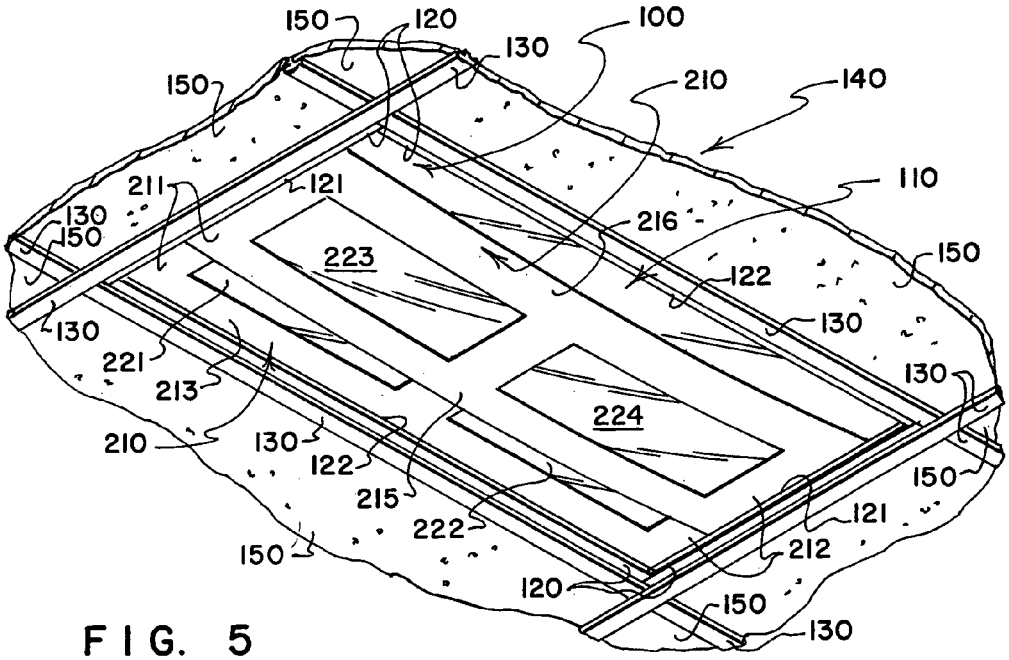
FIG. 5 is a perspective view of the ceiling mounted light fixture and the installed paint shield element of FIG. 4, with the other of the paint shield elements shown in FIG. 1 having its opposite end regions inserted between the downwardly facing surfaces of opposed end regions of the lens and the upwardly facing surfaces of fixture frame components that normally engage and support the opposite end regions of the lens.

Each of the paint shield elements 210 preferably is defined by a single sheet of relatively stiff cardboard, fiberboard or chipboard stock, or the like—except that the central regions 221, 222, 223, 224 are defined by openings formed through the stiff stock and covered by thin transparent or translucent film such as Mylar or parchment paper, or other material that preferably is selected to resist impact damage, ripping and tearing while permitting light to pass therethrough. The relatively stiff stock is selected to provide a degree of rigidity and stiffness that will resist sag when installed as depicted in FIG. 6, but which will permit central portions thereof to be temporarily deflected downwardly during installation, as is depicted in FIGS. 3 and 5.

Referring in sequence to FIGS. 2 through 6, the manner in which the paint shield elements 210 of the paint shield 200 are installed to mask the lens 100 of the fixture 110 will now be described. Starting with FIG. 2 (and referring also to FIG. 8 wherein an enlarged cross-sectional view is provided), the paint shield 200 is installed by inserting one of the end regions 212 of one of the paint shield elements 210 into the C-shaped channel of the end component 212 of the frame 210 between a downwardly facing surface 108 (see FIG. 8) of the end region 102 of the lens 100 and an upwardly facing surface 128 (see FIG. 8) that is defined by a bottom flange or lip of the end component 121 of the fixture frame 120 that normally underlies, engages and supports the downwardly facing surface 102.

Figure 2:
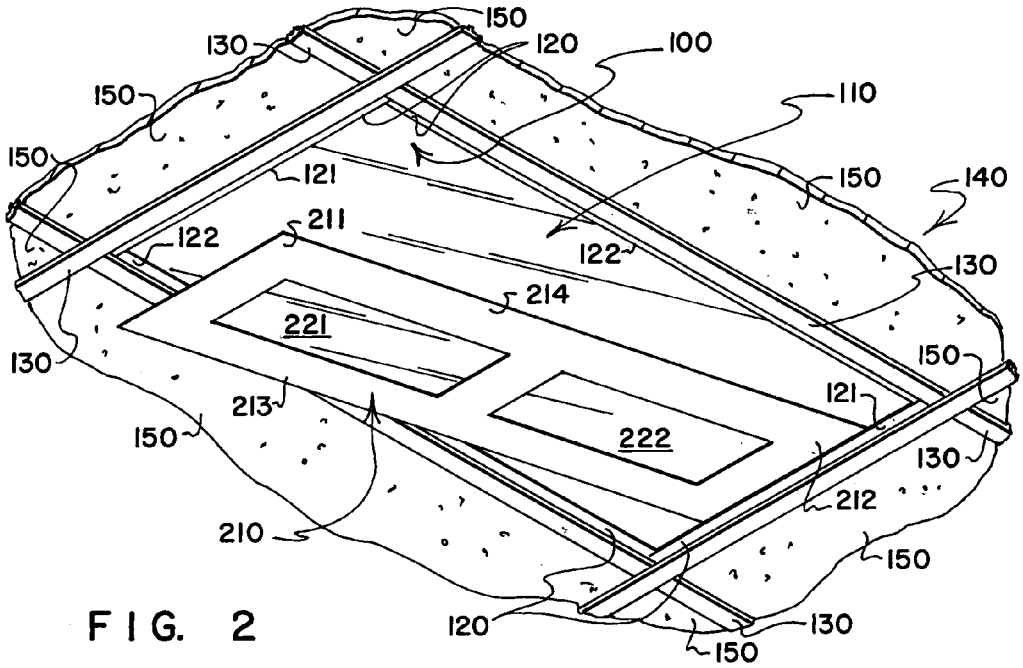
FIG. 2 is a perspective view of the ceiling mounted light fixture of FIG. 1 with one end region of one of the paint shield elements of FIG. 1 shown inserted between the downwardly facing surface of an end region of the lens and the upwardly facing surface of a fixture frame component that normally engages and supports the end region of the lens.
Figure 3:
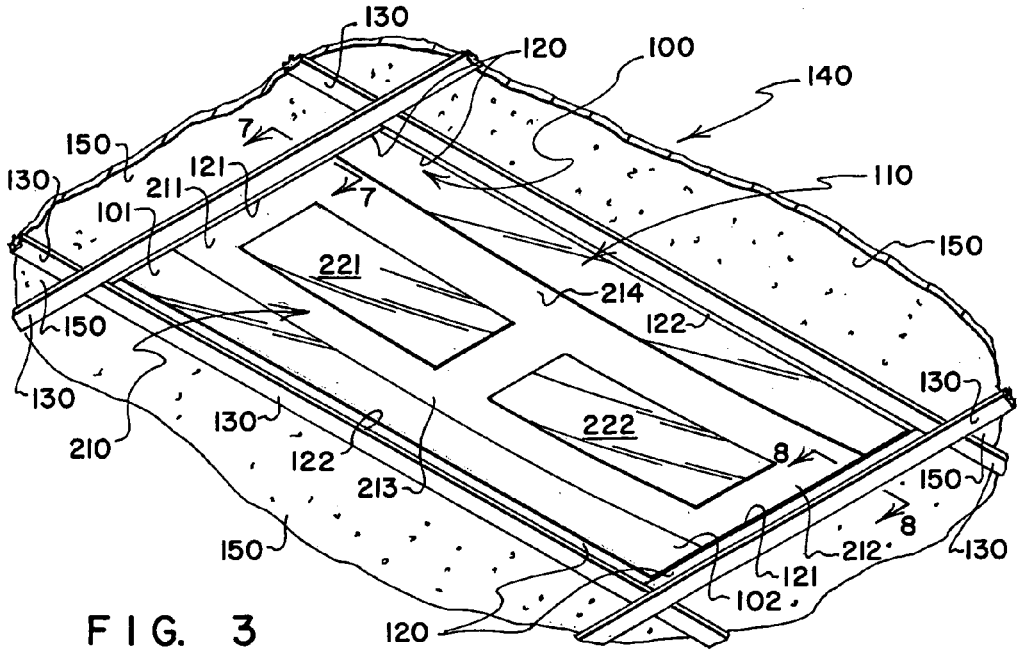
FIG. 3 is a perspective view of the ceiling mounted light fixture and paint shield element of FIG. 2 with opposed end regions of the paint shield element shown inserted between the downwardly facing surfaces of opposed end regions of the lens and the upwardly facing surfaces of fixture frame components that normally engage and support the opposite end regions of the lens.

Referring next to FIG. 3 (and referring also to FIG. 7 wherein an enlarged cross-sectional view is provided), the same paint shield element 210 that is shown in FIG. 2 then has its opposite end region 211 inserted into the C-shaped channel of the end component 212 of the frame 210 between a downwardly facing surface 107 (see FIG. 7) of the end region 101 of the lens 100 and an upwardly facing surface 127 (see FIG. 7) that is defined by a bottom flange or lip of the end component 121 of the fixture frame 120 that normally underlies, engages and supports the downwardly facing surface 101.

Figure 4:
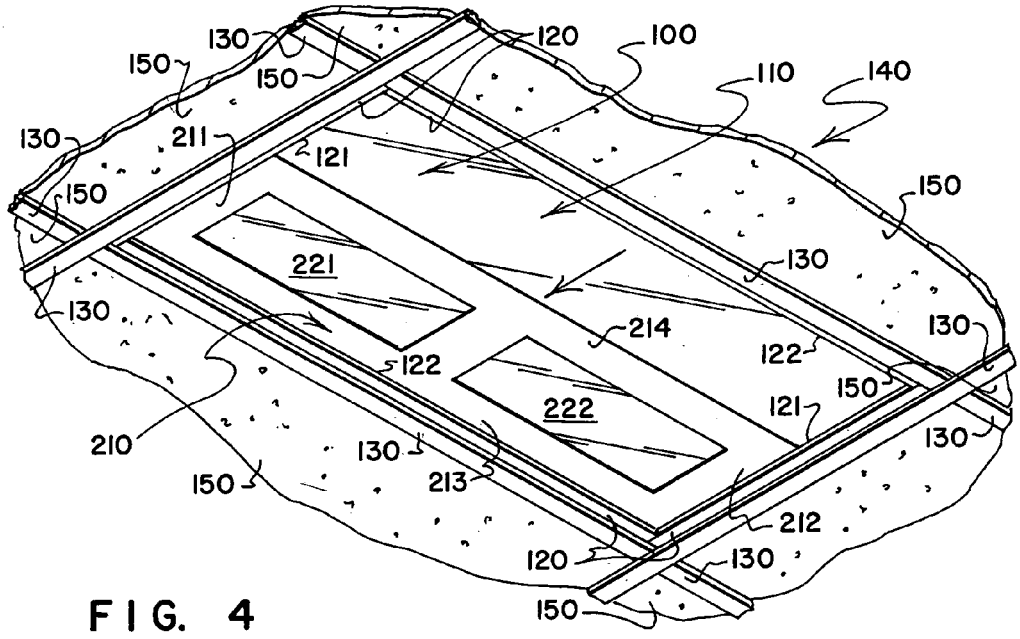
FIG. 4 is a perspective view of the ceiling mounted light fixture and paint shield element of FIG. 3 with the paint shield element slided transversely to cause side portions thereof to be inserted between the downwardly facing surface of one of side of the lens and the upwardly facing surface of a fixture frame component that normally engages and supports the side portion of the lens.

Referring next to FIG. 4, the paint shield element 210 shown in FIG. 3 (which has its opposite ends 211, 212 supported by the frame end components 121) is slided transversely toward one side of the frame 120 to insert the side portion 213 of the paint shield element 210 into the C-shaped channel of the side component 122 of the frame 120—by which arrangement the paint shield element 210 has its opposite end regions 211, 212 supported by the frame end components 121 and its side 213 supported by one of the frame side components 122 so that the paint shield element 210 serves to mask approximately one half of the lens 100 of the light fixture 110.

Referring next to FIG. 5, the other of the paint shield elements 210 shown in FIG. 1 then has its opposite end regions 211, 212 inserted into the C-shaped channels defined by the frame end components 121 (just as has been described in conjunction with the first-installed paint shield element depicted in FIGS. 2 and 3), and is slided sidewardly to the position illustrated in FIG. 6 to insert the side region 215 into the C-shaped channel defined by the other of the side components 122 of the frame 120 so that the second paint shield member 210 has its opposite end regions 211, 212 and its side region 216 supported by the frame 120, while the side region 215 is positioned to overlap the side region 214 of the other of the paint shield elements 210.

The extent of their overlap of the side regions 214, 215 is not so great as to permit either of the side regions 214, 215 to block any portion of any of the transparent or translucent central regions 221, 222, 223, 224. Thus, fixture generated light to pass through the transparent or translucent central regions 221, 222, 223, 224.

Figure 9:
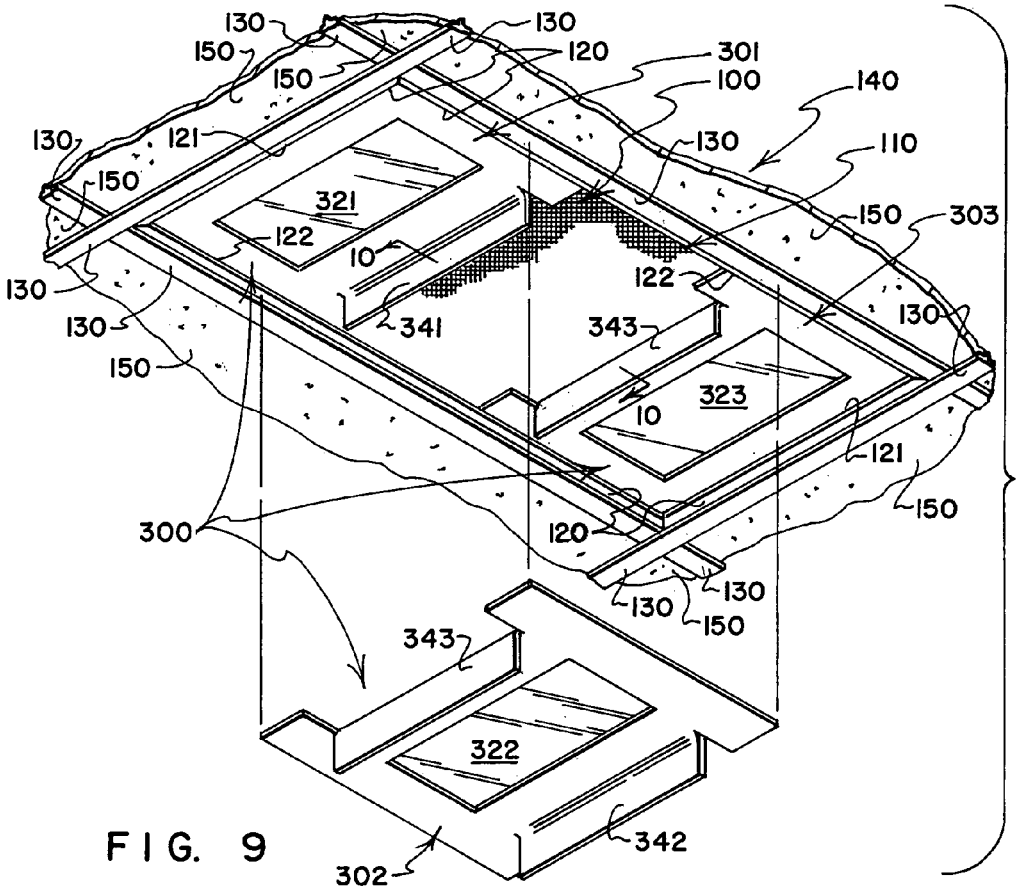
FIG. 9 is an exploded perspective view of showing the ceiling mounted light fixture of FIG. 1 and a second embodiment of paint shield that employs three paint shield elements to mask the lens of the fixture, with two of the paint shield elements installed to mask opposite end regions of the lens, and with a third paint shield element not yet installed.

What is intended to be illustrated by the three element paint shield embodiment 300 that is depicted in FIG. 9 is: 1) that paint shields that embody features of the present invention can be comprised of more than two paint shield elements; 2) that the paint shield elements of paint shields that embody features of the present invention need not be identical in size or in configuration; 3) that selected parts of overlapped regions of paint shields that embody features of the present invention may be designed to be folded away from a main plane occupied by major other portions of the paint shield, in this case by being folded or turned downwardly (or provided with some other form of stiffening formation that serves to stiffen the paint shield elements to prevent sag; and 4) that the stiffening formations of adjacent overlapped regions of adjacent paint shield elements may engage each other so as to assist in retaining the paint shield elements in their installed positions.

Referring to FIG. 9 wherein the same numerals used in FIG. 1 to depict identical light fixture and ceiling components, it will be seen that a paint shield 300 is comprised of three shield elements 301, 302, 303; and that each of the three paint shield elements 301, 302, 303 is comprised of a one-piece sheet of relatively thick, relatively stiff material (indicated in FIG. 10 by the numeral 398) and a one-piece sheet of relatively thin and tear resistant transparent or translucent film such as Mylar or other plastic materials, or parchment paper (indicated in FIG. 10 by the numeral 399)—which are the same materials that preferably are utilized to form the other paint shield elements of the other paint shield embodiments disclosed herein. The thin, tear resistant, transparent or translucent film material 399 is used to cover openings formed through the thicker, relatively stiff material 398 to provide central regions 321, 322, 323 through which fixture generated light may pass.

Figure 10:
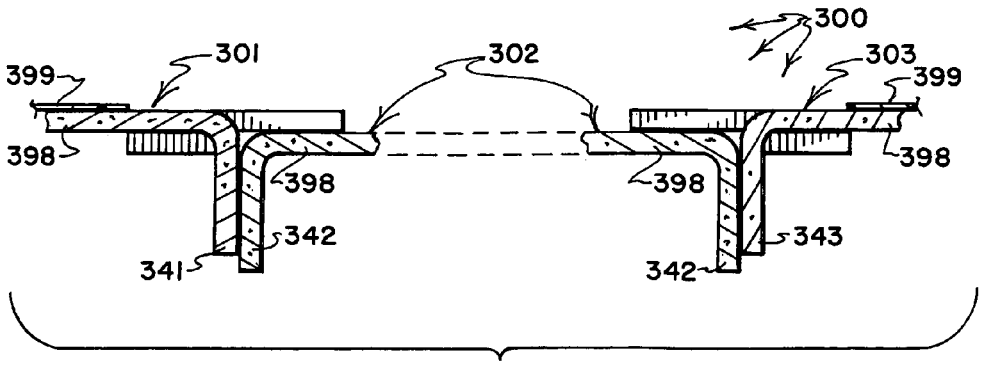
FIG. 10 is an enlarged foreshortened cross-sectional view as seen from a plane indicated by a line 10—10 in FIG. 9 at a time after the third paint shield element has been installed to mask central regions of the lens, with the view showing in greater detail how turned-down parts of overlapping portions of the paint shield elements may abutting engage to assist in holding the paint shield elements in position as they also serve to stiffen overlapped paint shield portions that extend in an otherwise unsupported manner across the face of the lens.

Referring to FIGS. 9 and 10, adjacent ones of the paint shield elements 301, 302, 303 have overlapping portions with parts thereof cut away and turned away from a main plane occupied by major other portions of the paint shield 300 to define downwardly extending portions 341, 342, 343, respectively, that preferably are configured to engage (as is best illustrated in FIG. 10 where adjacent downwardly turned portions 341, 342 are seen to engage, and where adjacent downwardly turned portions 342, 343 are seen to engage).

Figure 11:
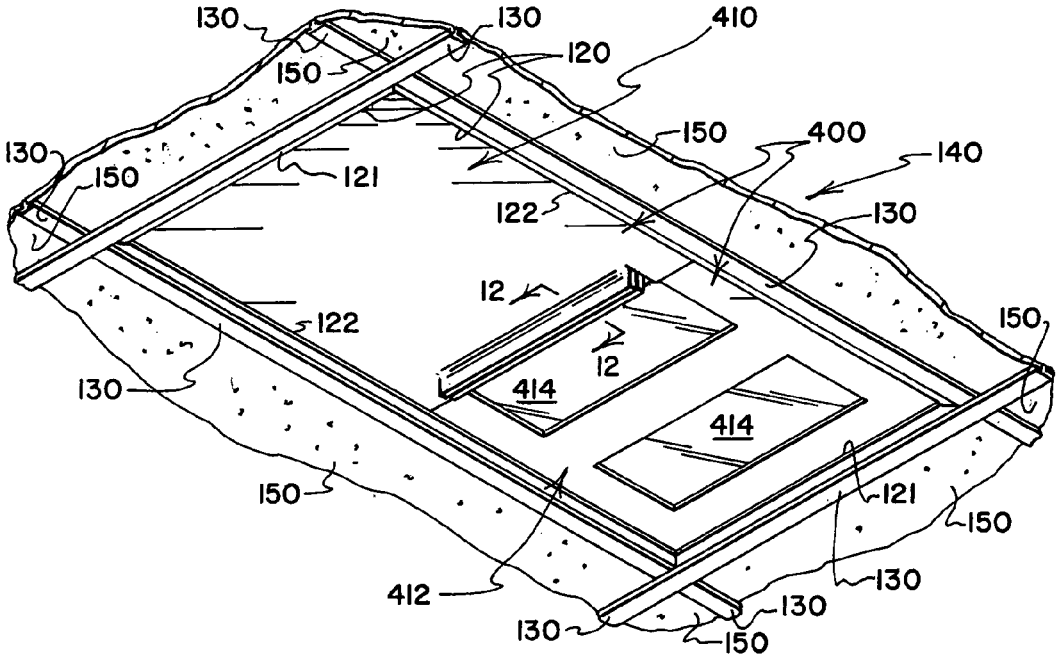
FIG. 11 is an exploded perspective view showing the ceiling mounted light fixture of FIG. 1 and a third embodiment of paint shield that employs two paint shield elements to mask the lens of the fixture, with one of the elements having transparent or translucent central portions, with the other of the elements having no transparent or translucent central portions, and with parts of overlapped portions of the paint shield elements being downwardly turned to stiffen the paint shield elements and engaged to assist in holding the paint shield elements in their installed positions.

What is intended to be illustrated by the paint shield embodiment 400 depicted in FIG. 11 is that paint shield elements that embody features of the present invention do not need to be identically configured; nor do they necessarily each need to be provided with one or more central regions that are transparent or translucent. The depicted paint shield elements 410, 412 are neither identically configured, nor do they both carry transparent or translucent central regions—only the paint shield element 412 is provided with transparent central regions 414, while the paint shield element is formed from a single relatively stiff sheet of material that carries no transparent or translucent film.

Figure 12:
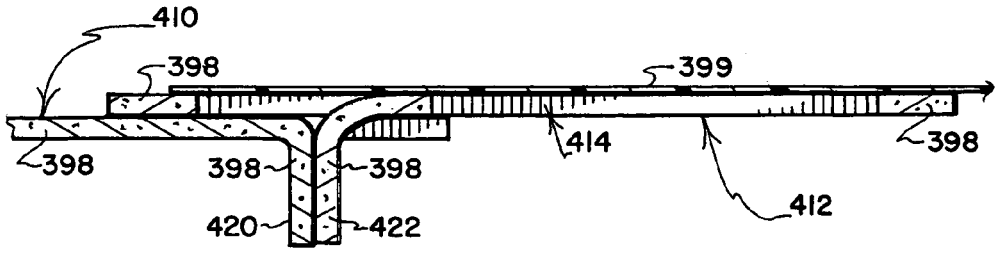
FIG. 12 is an enlarged cross-sectional view as seen from a plane indicated by a line 12—12 in FIG. 11.

As is depicted in FIGS. 11 and 12, overlapping portions of the paint shield elements 410, 412 have parts thereof cut away to permit their being turned to define depending elements 420, 422 that engage so as to stiffen the paint shield elements to prevent them from sagging while being installed. Although the elements 410, 412 are of much the same size, they can be very differently sized. For example, one of two paint shield elements (perhaps the one that carries translucent or transparent central regions) could be made significantly larger in size than the other; and, one of the elements (perhaps the smaller one that has no transparent or translucent central regions) might be made from thinner stock than the other.

Figure 13:
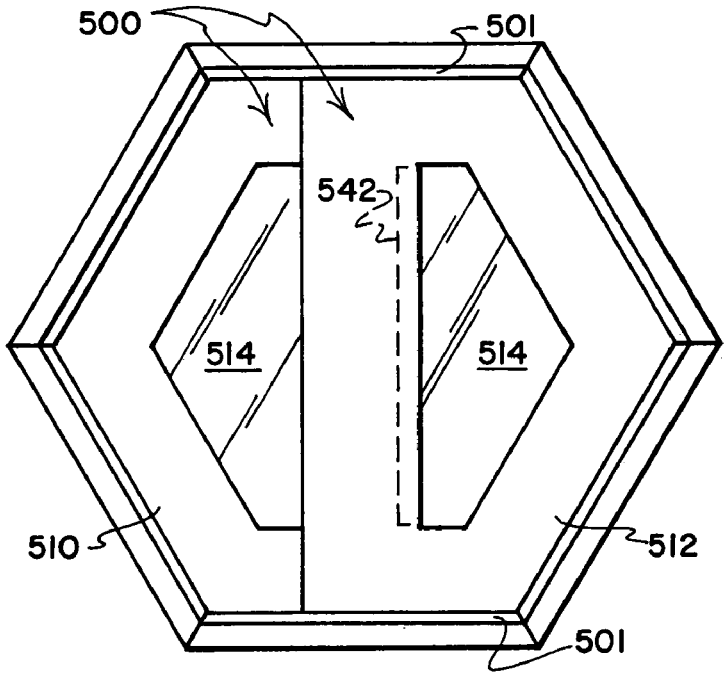
FIG. 13 is a bottom plan view of a hexagonal light fixture with a fourth embodiment of plural element paint shield installed thereon to mask the lens thereof.
Figure 14:
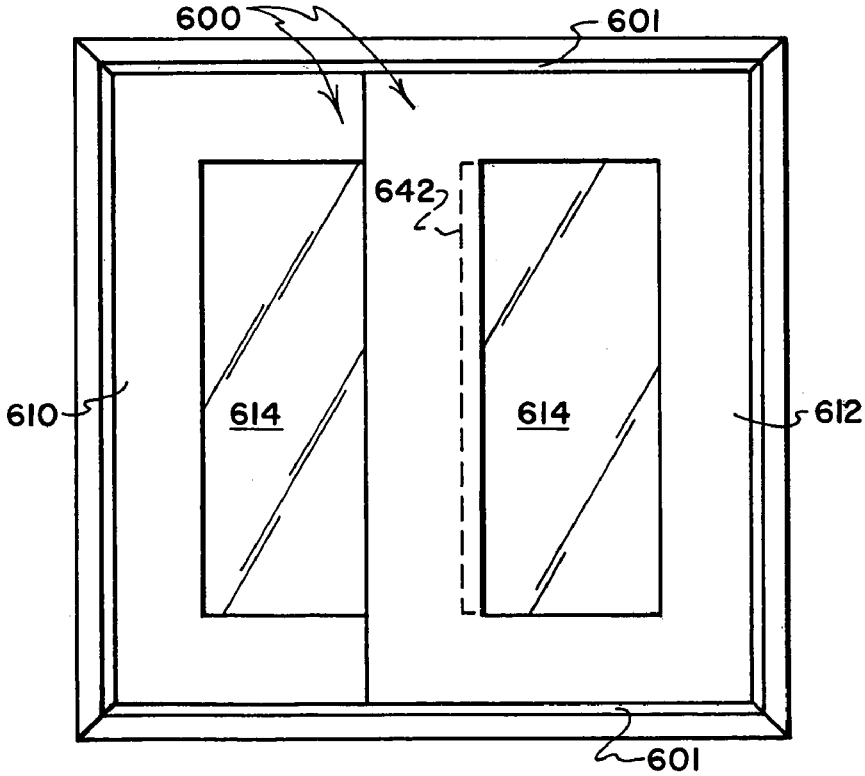
FIG. 14 is a bottom plan view of a square light fixture with a fifth embodiment of plural element paint shield installed thereon to mask the lens thereof.

What is intended to be illustrated by the two element paint shield embodiments 500, 600 that are depicted in FIGS. 13 and 14 is that is that plural paint shield elements embodying features of the present invention may be used to mask light fixture lenses or other similar devices that take a variety of shapes. In the hex-shaped paint shield embodiment 500, two identical paint shield elements 510, 512 have transparent central regions 514 and are installed in the same way that has been described above, namely by inserting their opposite end regions and then sliding the elements 510, 512 transversely to positions wherein the elements 510, 512 cooperate to mask the lens of a hexagonal fixture. In the square-shaped paint shield embodiment 600, two identical paint shield elements 610, 612 have transparent central regions 614 and are installed in the same way that has been described above, namely by inserting their opposite end regions and then sliding the elements 610, 612 transversely to positions wherein the elements 510, 512 cooperate to mask the lens of a square fixture. If it is desired to provide the paint shields 500, 600 with stiffening formations, fold-down flaps indicated by dotted lines 542, 642 may be provided adjacent the transparent central regions 514, 614.

A feature of the preferred practice of the present invention that is illustrated by all of the paint shield embodiments depicted in the drawings hereof is that, when working with a light fixture lens that has at least two opposed, substantially parallel extending sides, the paint shield elements used to mask the lens of such a fixture preferably each have one of their length and width dimensions chosen to substantially equal the distance between the two opposed, substantially parallel extending sides of the lens. Thus, in the fixtures depicted in FIGS. 13 and 14, for example, the paint shield elements 710 both have common length dimensions that substantially equal the distance between opposed parallel sides of a lens that is covered by the paint shield elements 710, and the paint shield elements 810 both have common length dimensions that substantially equal the distance between opposed parallel sides of a lens that is covered by the paint shield elements 910. By this arrangement, opposite end regions of each of the paint shield elements 710, 810 are supported by light fixture frame lips 501, 601, respectively, that underlie the opposite end regions of the paint shield elements 710, 810.

A further feature of the preferred practice of the present invention that is illustrated by all of the paint shield embodiments depicted in the drawings hereof is that the plural paint shield elements that are used to temporarily protectively cover each of the depicted fixture lenses has a size that is less than the size of its associated lens. By this arrangement, opposite ends or opposite sides of each of the paint shield elements can be inserted between frame lips and opposite edge portions of the lens by deflecting downwardly central portions of the paint shield elements (as shown, for example in FIGS. 3 and 5), whereafter the end-supported or side-supported paint shield elements can be slided along the supporting frame lips to an installed position wherein each of the paint shield elements protectively covers a different region of the lens of the fixture, with adjacent ones of the paint shield elements being partially overlapped to ensure that the resulting paint shield provides a full cover to protect the front face of the lens of the fixture when paint is being applied nearby.

Figure 15:
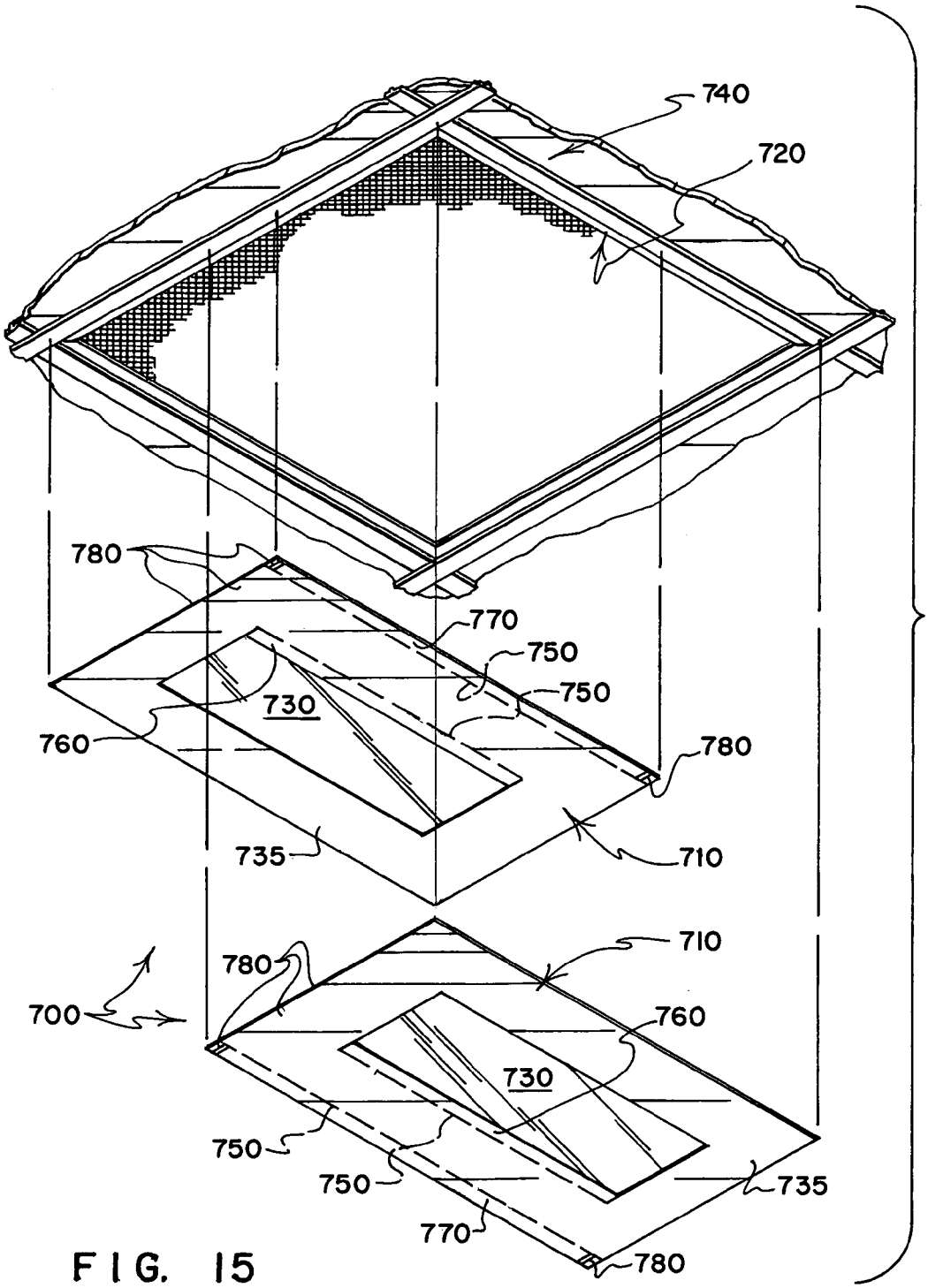
FIG. 15 is an exploded perspective view showing a substantially square light fixture with two paint shield elements that provide a sixth form of the invention.
Figure 16:
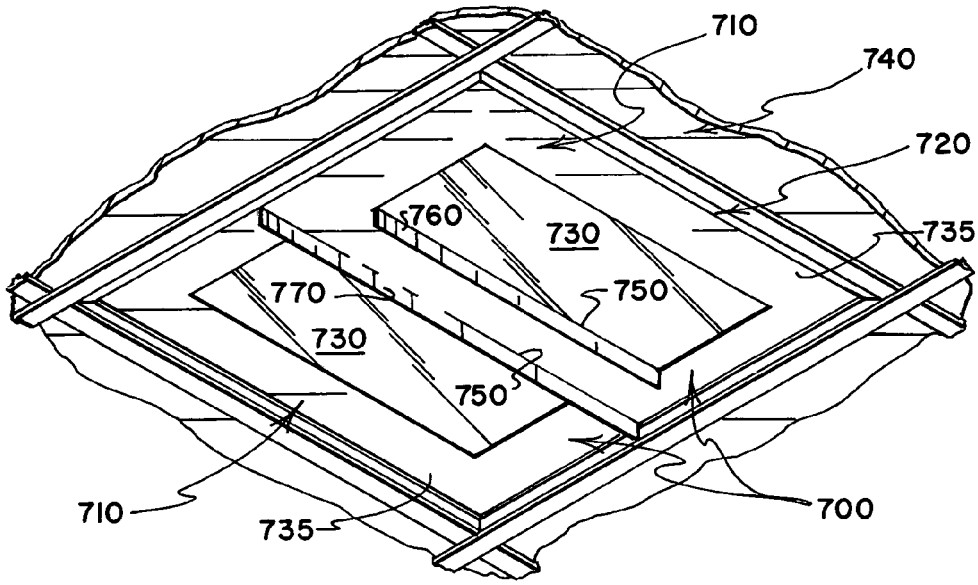
FIG. 16 is a perspective view showing the paint shield elements of FIG. 15 installed on the fixture.

What is shown in FIG. 15 are two identically configured paint shield elements 710 that cooperate to form a paint shield 700 when installed in a substantially square light fixture frame 720, as is depicted in FIG. 16 supported in a suspended ceiling 740. Although the paint shield elements 710 are depicted as having transparent central regions 730 that permit fixture generated light to pass therethrough, with the transparent central regions 730 being surrounded by opaque shield portions 735, it will be understood that selected portions or substantially all of each of the paint shield elements 710 can be formed from opaque, translucent or transparent materials as may be appropriate for a particular application to permit or prevent fixture generated light from passing therethrough. This versatility of material selection holds true for all of the paint shield elements shown in the accompanying drawings.

In the depicted paint shield embodiment 700, fold lines or lines of weakness 750 (typically formed by pressing the material of the paint shield elements 710 to compact it, or by press-slitting an array of openings through portions of the material of the paint shield elements 710) connect shield portions 760, 770 that can be turned or folded away from a plane occupied by major other portions of the installed paint shield elements, as depicted in FIG. 16 wherein one of each of the fold-down portions 760, 770 has been turned down.

In providing the paint shield elements of the present invention with turn-away or turn-down portions that can be pivoted or folded out of a main plane occupied by major other portions of an installed paint shield, the preferred approach taken by the present invention is to provide these turn-away or turn-down portions at one of two selected positions: either 1) adjacent where relatively thick, relatively heavy stock (i.e., material typically selected from among cardboard, fiberboard, chip-board, stiff-sheet plastic or the like) is provided with an opening that is covered with much lighter transparent or translucent material (i.e., material such as parchment paper or a thin film of tear resistant plastic such as Mylar, polypropylene or the like that permits fixture generated light to pass therethrough), as is exemplified by the turn-down portion 760 depicted in FIG. 16; or 2) adjacent a transversely extending edge of the paint shield element, as is exemplified by the turn-down portion 770 depicted in FIG. 16.

Providing fold lines 750 to connect the turn-down segments 760, 770 to other portions of the paint shield elements 710 serves a primary purpose of making it easier for shield installers to turn down the segments 760, 770 to stiffen the installed elements 710 of the paint shield 700; and, can also serve a secondary purpose of adding a stiffening formation to the paint shield elements 710 that helps to rigidify the shield elements 710 even if the fold-down portions 760, 770 are not folded down after the shield 700 has been installed. Stated in another way, the fold lines 750 (where material of the paint shield elements 710 preferably has been densified as by being forcibly pressed together to define the fold lines 750) in an of themselves serve to stiffen and rigidify the paint shield elements 710: thus, in the installed configuration depicted in FIG. 16 (wherein only one of the two fold-down segments 760 is turned down, and wherein only one of the two fold-down segments 770 is turned down), the two fold-down segments 760, 770 that are not turned down (and thus are not seen in FIG. 16) are connected by fold lines 750 (also not seen in FIG. 16) that serve to strengthen and rigidify the paint shield elements 710—and therefore add to the rigidification that is provided by the other two fold lines 750 and by the two segments 760, 770 that are folded down.

As will be noted in FIG. 15, visible guide formations 780 have been provided along edge regions of the paint shield elements 710 to mark where folds or cuts can be made to diminish the size of the paint shield elements 710 (as may be needed to adjust the paint shield elements 710 to fit a variety of fixture lens sizes) or to cut away or fold portions of the paint shield elements 710 so that the fold-down portions 760, 770 can be folded down. Lines of weakness, creases or mere visible marks may be employed to provide the guide formations 780.

Figure 17:
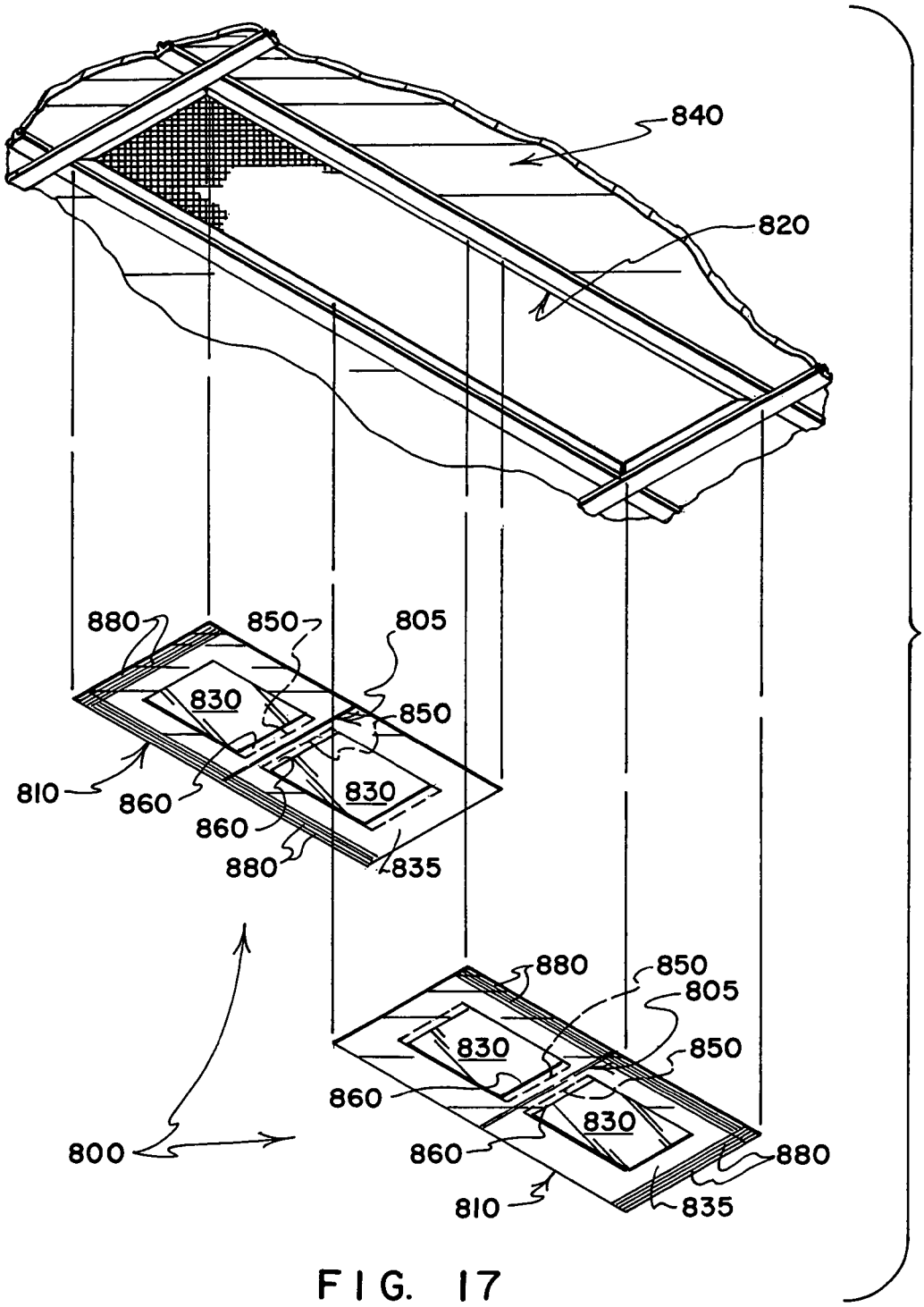
FIG. 17 is an exploded perspective view showing a relatively long, relatively narrow light fixture and a pair of paint shield elements that depict a seventh form of paint shield designed to protectively cover the lens of the fixture.

What is depicted in FIG. 17 are two identically configured paint shield elements 810 that cooperate to form a paint shield 800 when installed in relatively long, relatively thin rectangular light fixture frame 820 supported in a suspended ceiling 840. Each of the paint shield elements 810 has a transversely extending, centrally located fold line 805 press-formed thereacross, along which the paint shield elements 810 can be folded to cut in half the storage and transport footprint of the paint shield elements (i.e., it requires about half the space to store and ship the paint shield elements 810 if they are folded in half as opposed to being shipped or stored in a flat format). The fold lines 805 are located between two transparent windows 830 defined in central openings of opaque material 835 of the paint shield elements 810.

The fold lines 805, which extend transversely across the full widths of the paint shield elements 810, also may serve to admirably stiffen the installed paint shield elements 810 against sagging under the influence of the force of gravity. Fold lines such as those indicated by the numeral 805 in FIG. 17 also can be provided in the other paint shield elements depicted in the drawings hereof to cut in half the space occupied by paint shield elements when being stored or transported, and/or to serve as stiffening formations that extend transversely at selected locations to strengthen and rigidify the installed paint shield elements against sagging under the influence of the force of gravity.

Fold lines or lines of weakness 850 (typically formed by pressing the material of the paint shield elements 810 to compact it, or by press-slitting an array of openings through portions of the material of the paint shield elements 810) connect shield portions 860 that can be turned or folded away from a plane occupied by major other portions of the installed paint shield elements 810 when the paint shield elements 810 are installed in the fixture frame 820.

As will be noted in FIG. 17, visible guide formations 880 may be provided along edge regions (i.e., side and/or end regions) of the paint shield elements 810 to mark where cuts can be made to diminish the size of the paint shield elements 810 as may be needed to adjust the sizes of the paint shield elements 810 to correspond to the lens sizes of a variety of sizes of light fixtures.

Figure 18:
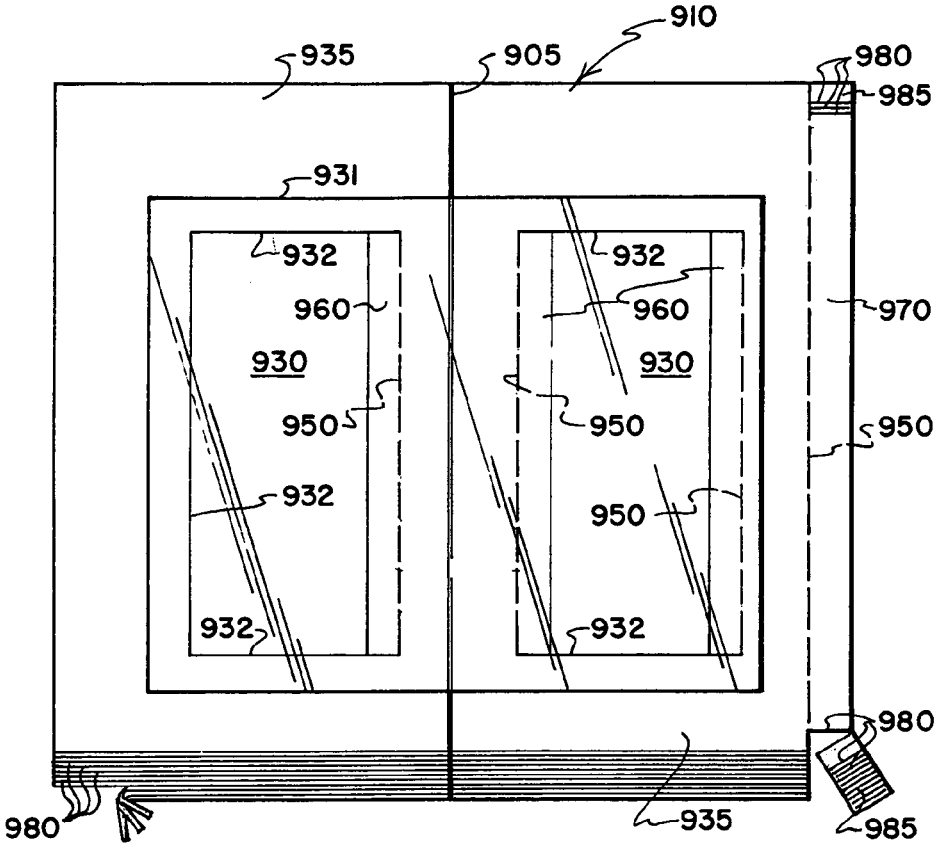
FIG. 18 is a top plan view of one of two identical paint shield elements that provide an eighty form of the invention, with the view showing rectangular boundaries of a sheet or film of transparent material that is adhered to a larger sheet of opaque material to bridge a pair of window openings defined by central portions of the opaque sheet so as to provide a pair of transparent windows through which fixture generated light can pass; and, FIG. 19 is a perspective view showing a pair of the paint shield elements of FIG. 18 installed to protectively cover the lens of a rectangular light fixture that is approximately twice the width of the fixture of FIG. 17.
Figure 19:
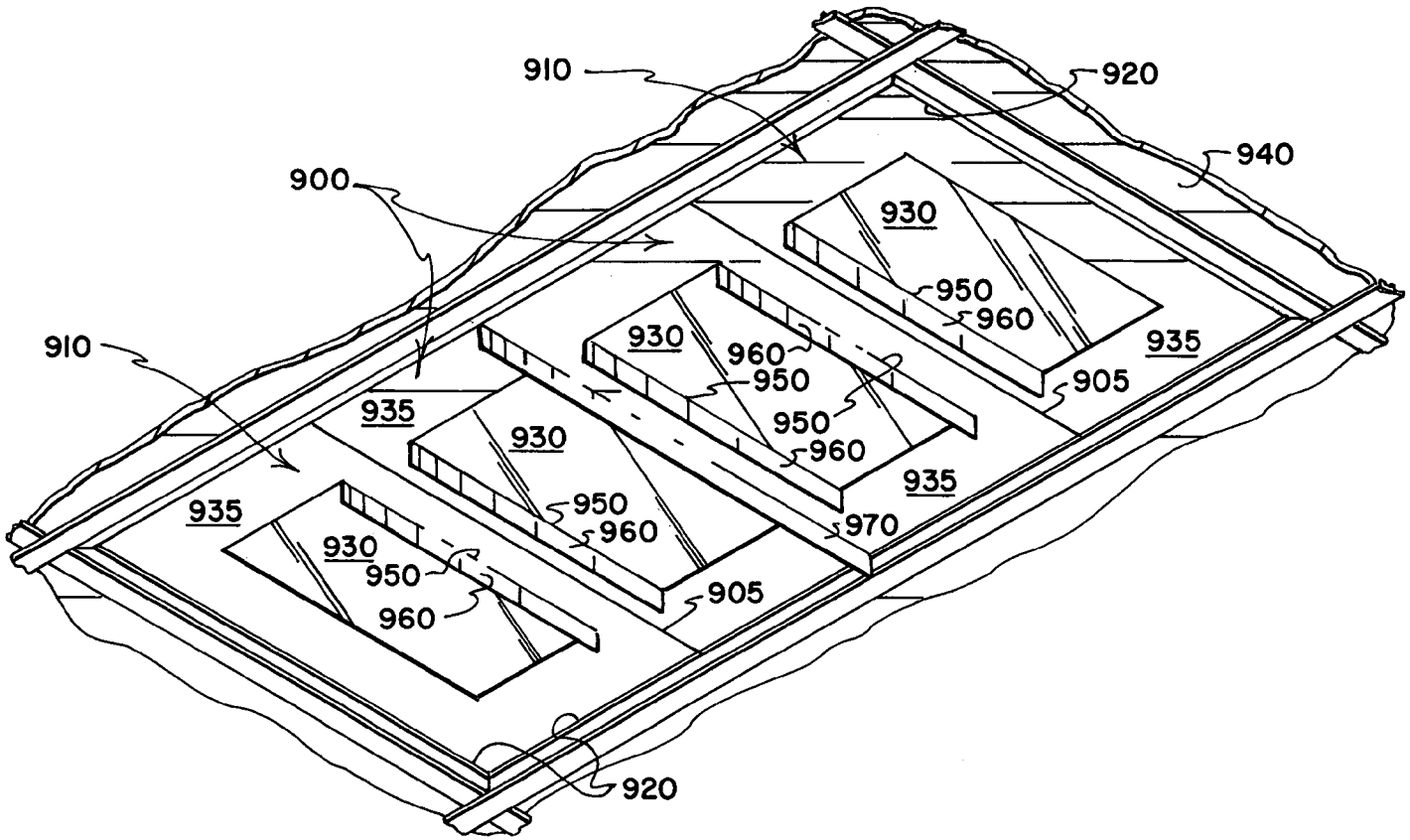

Referring to FIG. 18, one of a pair of identical paint shield elements 910 is depicted that can be used to form a two-element paint shield 900 for installation in a generally rectangular light frame fixture 920 supported in a suspended ceiling 940, as is depicted in FIG. 19. Fold lines 905 preferably are provided that extend transversely across central portions of the paint shield elements 910 to aid with folding the paint shield elements 910 in half for shipment and storage. Also, the fold lines 905 may serve to stiffen and rigidify the installed paint shield elements against sagging. The fold lines 905 are located between two transparent windows 930 defined in central openings of opaque material 935 of the paint shield elements 810. The transparent windows 930 are defined by a sheet or film 931 of transparent material that bridges openings 932 formed through opaque stock that surrounds the openings 932, as has been described in conjunction with the other paint shield members disclosed herein that permit fixture generated light to pass therethrough. Perimeter portions of the transparent sheet 931 are bonded to the opaque material 935 in a manner that seals the openings 932 to prevent the passage of paint therethrough.

Fold lines or lines of weakness 950 (typically formed by pressing the material of the paint shield elements 910 to compact it, or by press-slitting an array of openings through portions of the material of the paint shield elements 910) connect shield portions 960, 970 that can be turned or folded away from a plane occupied by major other portions of the installed paint shield elements, as depicted in FIG. 19 wherein selected ones of the fold-down portions 960, 970 have been turned down. The fold lines 950 may serve dual purposes, namely to facilitate folding of the material of the paint shield elements so that selected ones of the fold-down portions 960, 970 can be pivoted to extend out of a main plane occupied by major other portions of the paint shield elements 910 to stiffen and rigidify the paint shield elements 901, and to (in and of themselves) provide stiffening formations that help to stiffen and rigidify.

As will be noted in FIG. 18, visible guide formations 980 have been provided along edge regions of the paint shield elements 910 to mark where folds or cuts can be made to diminish the size of the paint shield elements 910 (as may be needed to adjust the paint shield elements 910 to fit a variety of fixture lens sizes) or to cut away or fold portions of the paint shield elements 910 so that the fold-down portions 960, 970 can be folded down. If the portion 970 is to be folded down, corner regions of the paint shield element 910 (indicated by the numeral 985 in FIG. 18) located at opposite ends of the fold-down portion 970 need to be removed to permit the fold-down portion 970 to be turned down between opposite sides of the frame 920, as depicted in FIG. 19.

As will be apparent from the foregoing description taken together with the accompanying drawings, the present invention provides simple and inexpensive paint shields, and methods of masking light fixtures utilizing paint shields of the type described, that permit light fixture lenses to be quickly, easily and relatively inexpensively masked by paint shield elements that can be reused repeatedly for a reasonable number of times, or that can be disposed of after a single use in view of their relatively low cost. After paint has been applied, the shield elements can be removed or "uninstalled" by reversing the steps that were followed to install them, i.e. by sliding the shield elements away from opposite sides of the light fixtures in which they are installed, and by deflecting downwardly their central regions to permit one then the other of their ends to be withdrawn.

While the invention has been described with a certain degree of particularity, it will be understood that the present disclosure of the preferred embodiment has been made only by way of example, and that numerous changes in the details of construction and the combination and arrangement of elements can be resorted to without departing from the true spirit and scope of the invention. It is intended that the patent shall cover, by suitable expression in the claims, such features of patentable novelty as exist in the invention.

What is claimed is:

1. A plural element paint shield for temporarily protectively covering a downwardly facing front face of a lens of a light fixture comprising a plurality of paint shield elements each of which is configured to protectively cover a separate portion of the front face of the lens when in an installed position wherein the paint shield elements extend in adjacent side by side relationship to substantially contiguously cover the front face of the lens, with adjacent ones of the paint shield elements having portions configured to overlap when the paint shield elements are in the installed position, with each of the paint shield elements having edge portions configured to extend between an upwardly facing surface of a frame of the light fixture and perimeter portions of the downwardly facing front face of the lens when in the installed position, and with each of the paint shield elements being formed from relatively thin, relatively stiff material that resists sagging under the influence of gravity, and which is pliable enough to permit central portions thereof to flex away from the front face of the lens as may be needed to permit the edge portions to be inserted between the upwardly facing surface of the frame and the perimeter portions of the downwardly facing front face of the lens to hold the paint shield in place so the front face of the lens is protected from being coated with paint during painting of adjacent from face portions of the frame, and one of the paint shield elements is provided with a stiffening formation that extends transversely across at least a selected portion thereof and wherein one of the paint shield elements is provided with a stiffening formation extending across at least a selected portion thereof.

2. The plural element paint shield of claim 1 wherein a first one of the plurality of paint shield elements is configured to cover one end region but not an opposite end region of the front face of the lens when in the installed position, and wherein a second one of the paint shield elements is configured to cover the opposite end region but not the one end region of the front face of the lens when in the installed position.

3. The plural element paint shield of claim 2 wherein the first one of the paint shield elements and the second one of the paint shield elements are sufficiently thin to permit their being initially installed one atop the other with the edge portions thereof overlying each other and extending between the frame of the light fixture and the perimeter portions of the front face of the lens, whereafter the first one of the paint shield elements and the second one of the paint shield elements may be moved in opposite directions toward the one end region and the opposite end region, respectively, to bring the paint shield elements to the installed position.

4. The plural element paint shield of claim 1 wherein a foldable portion of at least a selected one of the paint shield elements is connected to other portions thereof by a fold line that permits the foldable portion to be deflected out of a plane occupied by said other portions thereof so as to strengthen the paint shield against deflection under the influence of the force to gravity.

5. The plural element paint shield of claim 1 wherein all of the paint shield elements are of substantially equal size and are substantially identically configured.

6. The plural element paint shield of claim 1 wherein the plurality of paint shield elements consists of a first paint shield element and a second paint shield element that are substantially identical, and each has a size that is slightly greater than half of the size of the front face of the lens.

7. The plural element paint shield of claim 1 wherein at least one of the paint shield elements is formed primarily from thin, relatively stiff stock selected from a group of materials that includes cardboard, fiberboard, chipboard and plastic.

8. The plural element paint shield of claim 1 wherein at least one of the paint shield elements is formed primarily from material that permits light from a light fixture on which the paint shield is installed to pass therethrough.

9. The plural element paint shield of claim 1 wherein at least one of the paint shield elements has a central region formed primarily from material that permits light from a light fixture on which the paint shield is installed to pass therethrough.

10. A plural element paint shield for temporarily protectively covering a front face of a lens of a light fixture comprising a plurality of paint shield elements each of which is configured to protectively cover a separate portion of the front face of the lens when in an installed position wherein the paint shield elements extend in adjacent side by side relationship to substantially contiguously cover the front face of the lens, with adjacent ones of the paint shield elements having portions configured to overlap when the paint shield elements are in the installed position, with each of the paint shield elements having edge portions configured to extend between a frame of the light fixture and perimeter portions of the front face of the lens when in the installed position, and with each of the paint shield elements being formed from relatively thin, relatively stiff material that is pliable enough to permit central portions thereof to flex away from the front face of the lens as may be needed to permit the edge portions to be inserted between the frame and the perimeter portions of the front face of the lens, wherein at least one of the paint shield elements has a central region formed from material that permits light from a light fixture on which the paint shield is installed to pass therethrough, and a perimeter region that surrounds the central region formed from thin, relatively stiff stock selected from a group of materials that includes cardboard, fiberboard, chipboard, substantially transparent plastic, substantially translucent plastic and substantially opaque plastic.

11. The plural element paint shield of claim 10 wherein the material that permits light to pass therethrough is thin stock selected from a group of materials that includes materials that are transparent and materials that are translucent.

12. The plural element paint shield of claim 1 wherein all of the paint shield elements are comprised of thin material that, when in the installed position, closely overlies so as to extend substantially flatly alongside the front face of the lens of the light fixture, except that at least one of the paint shield elements has at least one portion that can be oriented to extend away from the front face of the lens so as to strengthen the paint shield to inhibit deflection of central portions of the paint shield under the influence of the force of gravity.

13. The plural element paint shield of claim 1 wherein at least one of the paint shield elements carries a visual indicator to guide trimming of edge portions thereof when there is a need to cut away said edge portions to permit the paint shield to be used with light fixture lenses that have at least one dimension that differs from at least one dimension of the at least one of the paint shield elements.

14. A plural element paint shield for temporarily protectively covering a front face of a lens of a light fixture comprising a plurality of paint shield elements each of which is configured to protectively cover a separate portion of the front face of the lens when in an installed position wherein the paint shield elements extend in adjacent side by side relationship to substantially contiguously cover the front face of the lens, with adjacent ones of the paint shield elements having portions configured to overlap when the paint shield elements are in the installed position, with each of the paint shield elements having edge portions configured to extend between a frame of the light fixture and perimeter portions of the front face of the lens when in the installed position, and with each of the paint shield elements being formed from relatively thin, relatively stiff material that is pliable enough to permit central portions thereof to flex away from the front face of the lens as may be needed to permit the edge portions to be inserted between the frame and the perimeter portions of the front face of the lens, wherein at least a selected portion of the perimeter of at least one of the paint shield elements is provided with a plurality of visible guide formations extending therealong to guide cutting of said one of the paint shield elements to a size that will permit said at least one of the paint shield elements to properly cover front face portions of the lenses of light fixtures of a variety of sizes.

15. The plural element paint shield of claim 14 wherein the visible guide formations are defined by a series of spaced-apart perforations that extend at least part-way through the material of said at least one of the paint shield elements.

16. The plural element paint shield of claim 14 wherein the visible guide formations are defined by scored lines of weakness formed in the material of said at least one of the paint shield elements.

17. A paint shield for protectively covering a downwardly facing lens of a light fixture of the type having a frame that extends perimetrically about and overlies perimeter portions of a front face of the lens, comprising a first paint shield element configured to cover one end region but not an opposite end region of the front face of the lens of the light fixture, a second paint shield element configured to cover the opposite end region but not the one end region of the front face of the lens of the light fixture, with the first and second paint shield elements being formed from relatively thin, relatively stiff material that resists sagging under the influence of gravity, and which is pliable enough to permit the first and second paint shield elements to have central portions thereof deflected away from the front face of the lens so that opposite side portions thereof have edges portions that can be inserted between opposite sides of the downwardly facing front face of the lens and an upwardly facing surface defined by opposite sides of the frame to hold the paint shield in place and to bring the first and second elements into an initial overlapped relationship wherein the elements cover neither of the one and opposite end regions of the lens, whereafter the first paint shield element may be slid toward the one end region, and the second paint shield element may be slid in an opposite direction toward the opposite end region to installed positions of the first and second paint shield elements wherein the first paint shield element covers the one end region of the front face of the lens, wherein the second paint shield element covers the opposite end region of the front face of the lens, and wherein overlapping portions of the first and second paint shield elements cover a central region of the front face of the lens to prevent paint from being applied to the lens during painting of adjacent front face portions of the frame, and one of the paint shield elements is provided with a stiffening formation that extends transversely across at least a selected portion thereof and wherein one of the paint shield elements is provided with a stiffening formation extending across at least a selected portion thereof.

18. A paint shield for protectively covering a lens of a light fixture of the type having a frame that extends perimetrically about and overlies perimeter portions of a front face of the lens, comprising a first paint shield element configured to cover one end region but not an opposite end region of the front face of the lens of the light fixture, a second paint shield element configured to cover the opposite end region but not the one end region of the front face of the lens of the light fixture, with the first and second paint shield elements being formed from relatively thin, relatively stiff material that is pliable enough to permit the first and second paint shield elements to have central portions thereof deflected away from the front face of the lens so that opposite side portions thereof can be inserted between opposite sides of the front face of the lens and opposite sides of the frame to bring the first and second elements into an initial overlapped relationship wherein the elements cover neither of the one and opposite end regions of the lens, whereafter the first paint shield element may be slid toward the one end region, and the second paint shield element may be slid in an opposite direction toward the opposite end region to installed positions of the first and second paint shield elements wherein the first paint shield element covers the one end region of the front face of the lens, wherein the second paint shield element covers the opposite end region of the front face of the lens, and wherein overlapping portions of the first and second paint shield elements cover a central region of the front face of the lens to prevent paint from being applied to the lens during painting of a front face of the frame, wherein the relatively thin, relatively stiff material that forms at least one of the first and second paint shield elements is connected by a line of weakness of the material to a portion of the material that can be folded down to project away from the front face of the lens of the light fixture so as to stiffen said at least one of the first and second paint shield elements.

19. The paint shield of claim 18 wherein the line of weakness is formed by linearly scoring the relatively thin, relatively stiff material to define a fold line along which the relatively thin, relatively stiff material can be folded.

20. The paint shield of claim 18 wherein the line of weakness is formed by providing spaced perforations that extend linearly to define a fold line along which the relatively thin, relatively stiff material can be folded.

21. A paint shield for protectively covering a lens of a light fixture of the type having a frame that extends perimetrically about and over-lies perimeter portions of a front face of the lens, comprising a first paint shield element configured to cover one end region but not an opposite end region of the front face of the lens of the light fixture, a second paint shield element configured to cover the opposite end region but not the one end region of the front face of the lens of the light fixture, with the first and second paint shield elements being formed from relatively thin, relatively stiff material that is pliable enough to permit the first and second paint shield elements to have central portions thereof deflected away from the front face of the lens so that opposite side portions thereof can be inserted between opposite sides of the front face of the lens and opposite sides of the frame to bring the first and second elements into an initial overlapped relationship wherein the elements cover neither of the one and opposite end regions of the lens, whereafter the first paint shield element may be slid toward the one end region, and the second paint shield element may be slid in an opposite direction toward the opposite end region to installed positions of the first and second paint shield elements wherein the first paint shield element covers the one end region of the front face of the lens, wherein the second paint shield element covers the opposite end region of the front face of the lens, and wherein overlapping portions of the first and second paint shield elements cover a central region of the front face of the lens to prevent paint from being applied to the lens during painting of a front face of the frame, wherein selected portions of the perimeters of the first and second paint shield elements are provided with visible guide formations that extend therealong to guide one in cutting the first and second paint shield elements down to sizes that will permit the first and second paint shield elements to properly cover the front faces of the lenses of light fixtures of a variety of sizes.

22. The paint shield of claim 21 wherein the guide formations are defined by scored lines of weakness.

23. The paint shield of claim 22 wherein the guide formations are defined by spaced perforations that at least partially cut through the material of the paint shield elements to assist with the trimming of the first and second paint shield elements to the size of a particular light fixture lens.

24. A self-supporting, easy-to-install and easy-to-remove paint shield for covering a generally rectangular downwardly facing lens of a ceiling-mounted light fixture of the type having a frame lip that underlies perimetrically extending edge portions of the generally rectangular lens, wherein the generally rectangular lens has a first pair of substantially parallel extending opposed edges separated by a first dimension that defines a length of the generally rectangular lens, and has a second pair of substantially parallel extending opposed edges separated by a second dimension that defines a width of the generally rectangular lens, wherein the paint shield is comprised of a plurality of relatively thin, relatively stiff paint shield elements that resists sagging under the influence of gravity, and are configured so that adjacent ones of the paint shield elements have portions that overlap slightly when the paint shield elements are installed to closely underlie and to substantially fully cover a front face of the generally rectangular lens, with the installed paint shield elements having edge portions that extend between an upwardly facing surface of the frame lip and the perimetrically extending edge portions of the downwardly facing lens so as to overlie the frame lip and to underlie the perimetrically extending edge portions of the downwardly facing lens to hold the paint shield in place so the front face of the lens is protected from being coated with paint during painting of adjacent front face portions of the frame, with each of the paint shield elements being of a size that is less than the size of the front face of the generally rectangular lens, and with each of the paint shield elements having a pair of substantially parallel extending opposed edge surfaces that are spaced apart by a distance that substantially equals a selected one of said first and second dimensions, and one of the paint shield elements is provided with a stiffening formation that extends transversely across at least a selected portion thereof and wherein one of the paint shield elements is provided with a stiffening formation extending across at least a selected portion thereof.

25. The paint shield of claim 24 wherein the paint shield elements are all of substantially equal size and are substantially identically configured.

26. The paint shield of claim 25 wherein the plurality of paint shield elements consists of a first paint shield element and a second paint shield element that are substantially identical, and each has a size that is slightly greater than half of the size of the front face of the lens.

27. The paint shield of claim 24 wherein at least one of the paint shield elements is formed primarily from thin, relatively stiff stock selected from a group of materials that includes cardboard, fiber-board, chipboard, substantially opaque plastic, substantially transparent plastic, and substantially translucent plastic.

28. The paint shield of claim 24 wherein at least one of the paint shield elements is formed primarily from material that permits light from a light fixture on which the paint shield is installed to pass therethrough.

29. The paint shield of claim 24 wherein at least one of the paint shield elements has a central region formed primarily from material that permits light from a light fixture on which the paint shield is installed to pass therethrough.

30. A self-supporting, easy-to-install and easy-to-remove paint shield for covering a generally rectangular lens of a ceiling-mounted light fixture of the type having a frame lip that underlies perimetrically extending edge portions of the generally rectangular lens, wherein the generally rectangular lens has a first pair of substantially parallel extending opposed edges separated by a first dimension that defines a length of the generally rectangular lens, and has a second pair of substantially parallel extending opposed edges separated by a second dimension that defines a width of the generally rectangular lens, wherein the paint shield is comprised of a plurality of relatively thin, relatively stiff paint shield elements that are configured so that adjacent ones of the paint shield elements have portions that overlap slightly when the paint shield elements are installed to closely underlie and to substantially fully cover a front face of the generally rectangular lens, with the installed paint shield elements having edge portions that extend between the frame lip and the perimetrically extending edge portions of the lens so as to overlie the frame lip and to underlie the perimetrically extending edge portions of the lens, with each of the paint shield elements being of a size that is less than the size of the front face of the generally rectangular lens, and with each of the paint shield elements having a pair of substantially parallel extending opposed edge surfaces that are spaced apart by a distance that substantially equals a selected one of said first and second dimensions, wherein at least one of the paint shield elements has a central region formed from material that permits light from a light fixture on which the paint shield is installed to pass therethrough, and a perimeter region that surrounds the central region formed from thin, relatively stiff stock selected from a group of materials that includes cardboard, fiberboard, chipboard, substantially transparent plastic, substantially translucent plastic and substantially opaque plastic.

31. The paint shield of claim 30 wherein the material that permits light to pass therethrough is thin stock selected from a group of materials that includes materials that are transparent and materials that are translucent.

32. The paint shield of claim 24 wherein the plurality of paint shield elements, when installed to protectively cover the front face of a light fixture lens, are comprised of thin material that closely overlies so as to extend substantially flatly alongside the front face of the lens of the light fixture, except that at least one of the paint shield elements has at least one portion that can be oriented to extend away from the front face of the lens so as to strengthen the paint shield to inhibit deflection of central portions of the paint shield under the influence of the force of gravity.

33. The paint shield of claim 24 wherein at least one of the paint shield elements carries a visual indicator to guide trimming of edge portions of the paint shield when there is a need to cut away said edge portions so to permit the paint shield to be used with light fixture lenses that have at least one dimension that differs from said first and second dimensions.

34. A self-supporting, easy-to-install and easy-to-remove paint shield for cover—ing a generally rectangular lens of a ceiling-mounted light fixture of the type having a frame lip that underlies perimetrically extending edge portions of the generally rectangular lens, wherein the generally rectangular lens has a first pair of substantially parallel extending opposed edges separated by a first dimension that defines a length of the generally rectangular lens, and has a second pair of substantially parallel extending opposed edges separated by a second dimension that defines a width of the generally rectangular lens, wherein the paint shield is comprised of a plurality of relatively thin, relatively stiff paint shield elements that are configured so that adjacent ones of the paint shield elements have portions that overlap slightly when the paint shield elements are installed to closely underlie and to substantially fully cover a front face of the generally rectangular lens, with the installed paint shield elements having edge portions that extend between the frame lip and the perimetrically extending edge portions of the lens so as to overlie the frame lip and to underlie the perimetrically extending edge portions of the lens, with each of the paint shield elements being of a size that is less than the size of the front face of the generally rectangular lens, and with each of the paint shield elements having a pair of substantially parallel extending opposed edge surfaces that are spaced apart by a distance that substantially equals a selected one of said first and second dimensions, wherein selected portions of the perimeter of at least one of the paint shield elements are provided with visible guide formations that extend therealong to guide one in cutting said one of the paint shield elements to a size that will permit said at least one of the paint shield elements to properly cover front face portions of the lenses of light fixtures of a variety of Sizes.

35. The paint shield of claim 34 wherein the visible guide formations are defined by a series of spaced-apart perforations that extend at least part-way through a portion of said at least one of the paint shield elements.

36. The paint shield of claim 34 wherein the visible guide formations are defined by scored lines of weakness.

37. A self-supporting, easy-to-install and easy-to-remove paint shield for covering a generally rectangular lens of a ceiling-mounted light fixture of the type having a frame lip that underlies perimetrically extending edge portions of the generally rectangular lens, wherein the generally rectangular lens has a first pair of substantially parallel extending opposed edges separated by a first dimension that defines a length of the generally rectangular lens, and has a second pair of substantially parallel extending opposed edges separated by a second dimension that defines a width of the generally rectangular lens, wherein the paint shield is comprised of a plurality of relatively thin, relatively stiff paint shield elements that are configured so that adjacent ones of the paint shield elements have portions that overlap slightly when the paint shield elements are installed to closely underlie and to substantially fully cover a front face of the generally rectangular lens, with the installed paint shield elements having edge portions that extend between the frame lip and the perimetrically extending edge portions of the lens so as to overlie the frame lip and to underlie the perimetrically extending edge portions of the lens, with each of the paint shield elements being of a size that is less than the size of the front face of the generally rectangular lens, and with each of the paint shield elements having a pair of substantially parallel extending opposed edge surfaces that are spaced apart by a distance that substantially equals a selected one of said first and second dimensions, wherein at least one of the paint shield elements has a fold-down portion that can be oriented to extend away from the lens of a light fixture to strengthen the paint shield when installed on said light fixture against deflection under the influence of the force of gravity.

38. The paint shield of claim 37 wherein the fold-down portion is connected to other portions of the at least one of the paint shield elements by a fold line that is visibly marked by press-formed scoring that diminishes the thickness of a portion of the at least one of the paint shield elements along said fold line.

39. The paint shield of claim 37 wherein the fold-down portion is connected to other portions of the at least one of the paint shield elements by a fold line that is visibly marked by a series of perforations that extend along the fold line.

40. A paint shield for temporarily protectively covering a generally rectangular downwardly facing lens of a ceiling mounted light fixture to shield the lens from having paint applied thereto when paint is being applied within the vicinity of the light fixture, wherein the generally rectangular lens has a width dimension and a length dimension, and wherein the fixture has a frame lip defining an upwardly facing surface that extends about and underlies peripheral edge portions of the downwardly facing lens, comprising a plurality of paint shield elements being formed from relatively thin, relatively stiff material that resists sagging under the influence of gravity, wherein the paint shield elements are configured to be positioned side by side in an array that forms a rectangular cover having length and width dimensions that substantially equal the length and width dimensions of the lens, and wherein the array of paint shield elements has peripheral edge portions configured to be inserted between the upwardly facing surface of the frame lip and the peripheral edge portions of the downwardly facing lens to hold the paint shield in place, with the elements supported in positions that closely underlie the lens when the array of paint shield elements is installed to protectively cover the lens, and one of the paint shield elements is provided with a stiffening formation that extends transversely across at least a selected portion thereof and wherein one of the paint shield elements is provided with a stiffening formation extending across at least a selected portion thereof.

41. The paint shield of claim 40 wherein the generally rectangular array of paint shield elements has a pair of opposite sides separated by a distance that substantially equals a selected one of the length and width dimensions of the lens, and wherein at least one of the paint shield elements bridges said distance so as to extend transversely across the lens of the fixture between the opposite sides of the fixture.

42. The paint shield of claim 41 wherein all of the paint shield elements bridge said distance between the opposite sides.

43. The paint shield of claim 40 wherein the plurality of paint shield elements consists of a first paint shield element configured to protectively cover one end region of the lens of the fixture, and a second paint shield element configured to protectively cover an opposite end region of the lens of the fixture, with the first and second paint shield elements being configured to partially overlap to cover a central region of the lens of the fixture.

44. The paint shield of claim 42 wherein the first and second paint shield elements are substantially identical, with each being formed from relatively thin, relatively stiff material, and each has a stiffening formation that extends transversely across at least selected portions thereof.

45. The paint shield of claim 40 wherein at least a central portion of at least one of the paint shield elements is formed from material that permits light from the fixture to pass therethrough.

46. The paint shield of claim 40 wherein at least one of the paint shield elements is formed at least in part from thin, relatively stiff stock selected from a group of materials that includes cardboard, fiberboard, chipboard and plastic.

47. A paint shield for temporarily protectively covering a generally rectangular lens of a ceiling mounted light fixture to shield the lens from having paint applied thereto when paint is being applied within the vicinity of the light fixture, wherein the generally rectangular lens has a width dimension and a length dimension, and wherein the fixture has a frame lip that extends about and underlies peripheral edge portions of the lens, comprising a plurality of paint shield elements configured to be positioned side by side in an array that forms a rectangular cover having length and width dimensions that substantially equal the length and width dimensions of the lens, and wherein the array of paint shield elements has peripheral edge portions configured to be inserted between the frame lip and the peripheral edge portions of the lens to support the elements in positions that closely underlie the lens when the array of paint shield elements is installed to protectively cover the lens, wherein at least one of the paint shield elements has a central region formed from material that permits light from the fixture to pass through the installed array of paint shield elements, and a perimeter region that surrounds the central region formed from thin, relatively stiff stock selected from a group of materials that includes cardboard, fiberboard, chipboard and plastic.

* * * * *